United States Patent [19]

Lister

[11] 4,084,647

[45] Apr. 18, 1978

[54] PNEUMATIC PERCUSSION HAMMER

[76] Inventor: William Lister, 36 Rabaul St., Moorooka, Queensland, Australia

[21] Appl. No.: 701,181

[22] Filed: Jun. 30, 1976

[30] Foreign Application Priority Data

Jul. 1, 1976 Australia ..... PC2183

[51] Int. Cl.[2] ..... B25D 17/14; E21C 7/02

[52] U.S. Cl. ..... 173/73; 173/80

[58] Field of Search ..... 173/73, 80

[56] References Cited

U.S. PATENT DOCUMENTS

| | | | |
|---|---|---|---|
| 3,225,841 | 12/1965 | Thompson | 173/73 |
| 3,896,886 | 7/1975 | Roscoe | 173/80 |
| 3,958,645 | 5/1976 | Curington | 173/73 |
| 3,964,551 | 6/1976 | Bassinger | 173/73 |
| 3,991,834 | 11/1976 | Curington | 173/73 |

*Primary Examiner*—Robert Hafer

*Attorney, Agent, or Firm*—Donald D. Jeffery

[57] ABSTRACT

A pneumatic percussion rock drilling hammer has a tubular housing for connection to a drill rod through which compressed air is introduced, the shank of a drill bit with an anvil at the top being slidable in the bottom of the housing, a piston being reciprocally slidable in the housing. Enlargements of the internal diameter of the housing define top, central and bottom pressure chambers. Air from the drill rod passes through a feed tube to an upper axial passage in the piston, and on the downstroke of the piston a lower axial passage therein engages a sliding seal tube leading to an air passage through the bit. Pressure ports in the piston direct air from the piston's upper axial passage to the top pressure chamber when the piston is raised, and to the bottom pressure chamber when the piston is lowered, and exhaust ports in the piston conduct air between its lower axial passage and the central pressure chamber and from the central chamber to the top pressure chamber when the piston is lowered.

2 Claims, 3 Drawing Figures

PNEUMATIC PERCUSSION HAMMER

BACKGROUND OF THE INVENTION

This invention relates to an improved pneumatic percussion hammer.

In general object of the invention is to provide an air operated percussion hammer, particularly for use in down-the-hole rock drilling, and usable on standard rotary drilling rigs, the hammer being particularly simple and economical to manufacture, capable of being made to smaller sizes than is generally practical with conventional percussion hammers, and efficient, sturdy, durable and trouble-free operation.

SUMMARY OF THE INVENTION

The present invention resides broadly in a pneumatic percussion hammer for rock drilling including a tubular housing; a top sub connected to the top of the housing for connection to, and to receive air under pressure from, a drill rod; an air feed pipe from the top sub extending coaxially into the housing; a bit, its shank mounted for limited slidable movement in the lower end of the housing; an anvil on the bit shank; a bit air passage through the anvil, shank and bit; a sliding seal tube extending axially into the housing from the bit air passage; a piston reciprocally slidable in the housing to strike the anvil on its down-stroke; a top pressure chamber in the housing about and above the piston; a bottom pressure chamber in the housing about and below the piston; a central chamber in the housing about an intermediate part of the piston; an upper axial passage in the piston slidably engaged with the air feed tube; a lower axial passage in the piston for slidable engagement, when the piston is on its down-stroke, with the sliding seal tube; pressure ports in the piston for directing air under pressure from the upper axial passage of the piston to the top pressure chamber when the piston is in raised position, and to the bottom pressure chamber when the piston is in lowered position; and exhaust ports in the piston for conducting air under pressure between the central chamber and the lower axial passage of the piston, and for conducting air, when the piston is lowered, from the central chamber to the top pressure chamber. Other features of the invention will become apparent from the following description.

BRIEF DESCRIPTION OF THE DRAWINGS

In order that a preferred embodiment of the invention may be readily understood and carried into practical effect, reference is now made to the accompanying drawings, wherein.

DESCRIPTION OF THE PREFERRED EMBODIMENT

Figure 1:
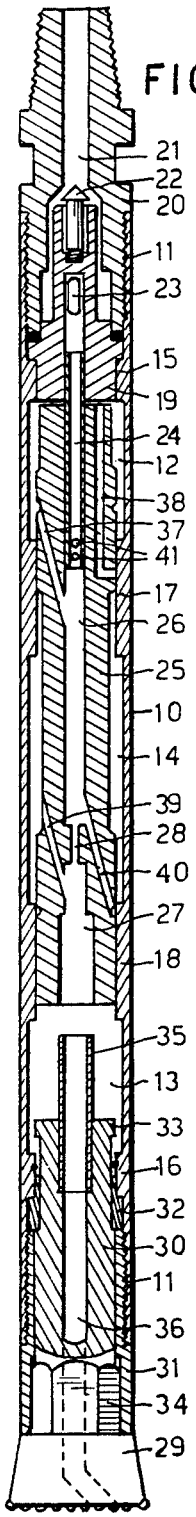
FIG. 1 is a sectional view of a pneumatic percussion hammer for rock drilling made according to the invention, its piston being in fully raised position.

The pneumatic hammer includes a cylindrical tubular housing 10, the bore of which is formed with enlarged-diameter parts and threaded parts which are arranged symmetrically so that the housing is reversible. An enlargement of the diameter of each end portion of the bore is threaded, as indicated at 11. Two further enlargements of the bore diameter define a top pressure chamber 12 and a bottom pressure chamber 12, and a central bore enlargement defines a central chamber 14. The annular sections of lesser internal diameter between these enlargements comprise a top shoulder 15, a bottom shoulder 16, and top and bottom piston bearings indicated at 17 and 18 respectively.

An air intake member 19 is located in the upper part of the housing 10 and has a circumferential flange bearing on the top shoulder 15, this member being secured in place by a top sub 20 screwed into the upper end of the housing, and having an axial air passage 21. In this air passage is an annular valve seating for a spring-loaded check valve 22 slidable in an axial aperture in the top of the air intake member. Air entering the axial air passage 21 of the air intake member 19 under pressure will unseat the valve 22, pass between the enlarged lower part of the axial passage 21 and the top part of the air intake member, and pass through radial holes 23 in the air intake member and thence through an air feed tube 24 extending coaxially down into the housing from the air intake member.

A piston 25 is slidable in the top and bottom piston bearings 17 and 18 of the housing 10, and is formed with an upper axial passage 26, in which the feed tube 24 is closely but slidably engaged, and with a lower axial passage 27, a restricted choke passage 28 interconnecting these two axial passages of the piston.

A bit 29 has its shank 30 slidably engaged in a driver sub 31 screwed into the threaded lower part 11 of the housing 10, the driver sub holding a split stop ring 32 against the bottom shoulder 16 of the housing. The enlarged top of the bit shank constitutes an anvil 33, and the stop ring 32 limits the downward movement of this anvil. The lower part of the bit shank is of hexagonal form, as indicated at 34, and the lower part of the bore of the driver sub 31 is of corresponding cross-section so that the bit is restrained against rotation relative to the housing 10. A slidable seal tube 35 has its lower end secured in an air passage 36 extending axially through the anvil 33 and bit shank 30 and leading to several passages passing obliquely through the bit 29. When the piston 25 is lowered to the anvil 33, as shown in FIG. 2 the sliding seal tube 35 is closely engaged in the lower axial passage 27 of the piston, and when the piston is raised, as shown in FIG. 1, it is lifted clear of the sliding seal tube.

Figure 2:
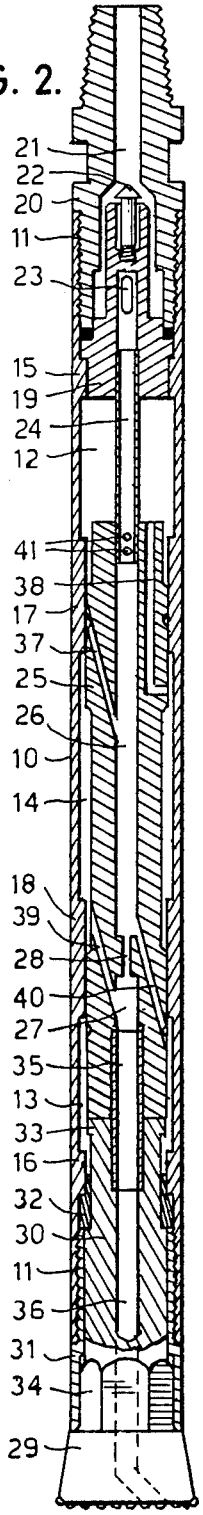
FIG. 2 is a sectional view of the hammer, its piston being brought down on the anvil of the hammer.

Assuming the piston 25 is to be raised initially, as shown in FIG. 1, when air under pressure is introduced through the feed tube 24, as before described, it passes into the upper axial passage 26 of the piston, and passes thence through an oblique pressure port 37 and into the top pressure chamber 12, and consequently the piston is driven down onto the anvil 33, as shown in FIG. 2. Air under pressure in the top pressure chamber 12 can then pass into the central chamber 14 by way of a top exhaust port 38 extending down from the top of the piston and radially out from its side, this port being closed by the upper bearing 17 when the piston is raised. From the central chamber 14, the air under pressure can pass through an oblique central chamber exhaust port 39 in the piston, leading to the lower axial passage 27, of the piston and through the sliding seal tube 35 and the axial passage 36 of the bit, for clearing fragments from the bore hole.

When the piston 25 is brought down to the anvil 33, as shown in FIG. 2, air introduced under pressure through the axial passage 21 of the top sub and entering the upper axial passage 26 of the piston, by way of the feed tube 24, is conducted through an oblique pressure port 40 from this axial passage to the bottom pressure chamber 13, and consequently the piston 25 is driven upwards, the pressure port 40 being quickly closed by the lower bearing 18. When the piston rises clear of the sliding seal tube 35, air under pressure in the bottom pressure chamber can expand into the lower axial passage 27 of the piston and thence through the oblique port 39 to the central chamber 14. With the up-stroke of the piston, air is compressed in the top pressure chamber to absorb shock and to give some reaction air-thrust before the pressure port 37 is opened to cause the piston to be driven down again, as before described.

Figure 3:
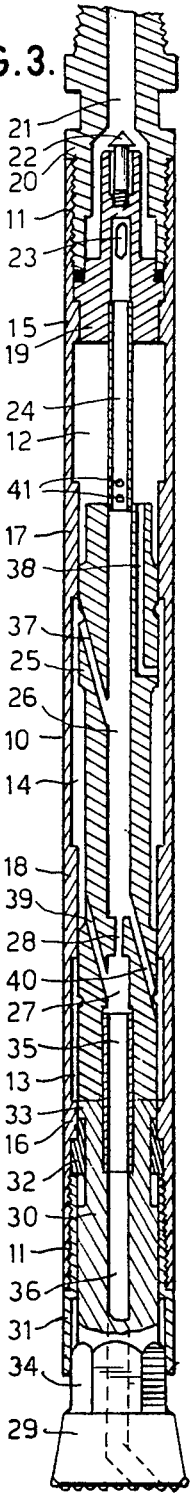
FIG. 3 is a sectional view of the hammer, the housing being raised relative to the bit to bring the parts to by-pass position.

When the hammer is drilling rock, the pressure applied to the tool keeps the driver sub 31 close down on to bit 29, as shown in FIGS. 1 and 2. If the housing 10 is lifted relative to the bit, as shown in FIG. 3, so that the anvil 33 is brought onto the stop ring 32, then the piston, on its down-stroke, will descend further, relative to the housing, than previously, uncovering radial holes 41 in the lower end of the feed tube 24. Consequently, the air introduced under pressure to the tool may pass through these holes into the top pressure chamber 12, through the top exhaust port 38 to the central chamber 14. From the central chamber 14, the air under pressure will pass to the bottom pressure chamber 13, by way of pressure port 37, axial passage 26 and pressure port 40, and will pass also through the central chamber exhaust port 39 to the lower axial passage 27 of the piston, and through the sliding seal tube 35 to the passage 36 through the bit. It will be seen, then, that the action of lifting the tool from the working face causes the air under pressure to by-pass the piston, bringing the operation of the tool to a halt, and at the same time allows extra air under pressure to clean out the bore hole.

The restricted passage or choke 38 permits extra air to flow through the passage 36 of the bit during normal operation of the hammer, this flow of air, however, being of insufficient volume to interfere with the reciprocation of the piston.

For clarity, the various ports of the piston have been shown in singular, but in practice it is preferred that a number, say three, should be provided of each.

I claim:

1. A pneumatic percussion hammer for rock drilling including:

a tubular housing, a top sub connected to the top of the housing, adapted to be connected to, and to receive air under pressure from, a drill rod, a cylindrical air feed tube extending from the top sub coaxially into the housing, said tube being formed with holes adjacent the bottom thereof, said tube apart from said holes serving no valving function;

a bit having a shank mounted for limited slidable movement in the lower end of the housing, an anvil on the bit shank, a bit air passage through the anvil, shank and bit, a sliding seal tube extending axially into the housing from the bit air passage, a piston reciprocally slidable in the housing and adapted to strike the anvil on its down-stroke, a top pressure chamber in the housing about and above the top of the piston, a bottom chamber in the housing about and below the piston, a central pressure chamber in the housing about an intermediate part of the piston, an upper cylindrical, axial passage in the piston, said passage being slidably engaged with the air feed tube, a lower axial passage in the piston adapted, when the piston is on its down-stroke, to engage slidably with the sliding seal tube, pressure ports extending through the walls of said piston and communicating with said upper and lower axial passages, said ports being adapted to direct air under pressure from the upper axial passage of the piston to the top pressure chamber when the piston is in raised position, and to the bottom pressure chamber when the piston is in lowered position, and exhaust ports in the piston adapted to conduct air under pressure between the central chamber and the lower axial passage of the piston, and to conduct air, when the piston is lowered, from the central chamber to the top pressure chamber.

2. A pneumatic percussion hammer according to claim 1 wherein said radial holes formed in the lower part of the air feed tube are adapted to conduct air under pressure from the feed tube to the top pressure chamber when the anvil and the piston are in lowermost position relative to the housing, concurrently with the admission of air under pressure from said upper axial passage of the piston through one of said pressure ports to the bottom pressure chamber, and the admission of air under pressure from said upper axial passage of the piston through the other of said pressure ports to the central chamber and from the central chamber through one of said exhaust ports to the sliding seal tube and the bit air passage.

* * * * *